US007109846B2

(12) United States Patent
Ljunggren et al.

(10) Patent No.: US 7,109,846 B2
(45) Date of Patent: Sep. 19, 2006

(54) METHOD AND SYSTEM FOR CONTROL AND MAINTENANCE OF RESIDENTIAL SERVICE NETWORKS

(75) Inventors: Per Henrik Ljunggren, Bromma (SE); Roland Henry Timgren, Jarfalla (SE); Hans Verner Thorsen, Lidingo (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 195 days.

(21) Appl. No.: 10/480,816

(22) PCT Filed: Jun. 13, 2002

(86) PCT No.: PCT/SE02/01143

§ 371 (c)(1),
(2), (4) Date: Aug. 27, 2004

(87) PCT Pub. No.: WO02/101993

PCT Pub. Date: Dec. 19, 2002

(65) Prior Publication Data

US 2004/0260406 A1 Dec. 23, 2004

(30) Foreign Application Priority Data

Jun. 13, 2001 (SE) ..... 102118

(51) Int. Cl.
*G08B 9/00* (2006.01)

(52) U.S. Cl. ..... 340/286.02; 340/521; 379/102.01

(58) Field of Classification Search ..... 340/286.02, 340/521, 531, 539.26, 870.03, 870.16, 870.17; 379/102.01, 102.05; 455/425
See application file for complete search history.

(56) References Cited

U.S. PATENT DOCUMENTS 5,905,438 A * 5/1999 Weiss et al. ..... 340/636.1

(Continued)

FOREIGN PATENT DOCUMENTS

WO 99/65192 A1 12/1999

(Continued)

OTHER PUBLICATIONS

Patent Application Publication: Petite; System and Method for Accessing Residential Monitoring Devices; Publ. No. 2001/0024163 A1; Sep. 27, 2001.

*Primary Examiner*—John Tweel, Jr.
(74) *Attorney, Agent, or Firm*—Nixon & Vanderhye P.C.

(57) ABSTRACT

The present invention discloses a system for controlling at least one residential property in a plurality of connected residential networks. The system comprises a remote control unit arranged to control residential properties, which remote control unit via the Internet is in connection with an access network, which is provided and supported by a telecommunications operator. Each connected residential network is divided into an open branch containing content terminals, such as a personal computer and an interactive information terminal. Furthermore the system includes a service gateway arranged in a secure branch of the residential network, the secure branch is provided with sub-controller means, each of which is in bi-directional connection with at least one sensor, the sub-controller means being adapted to activate various residential properties, measurement values from the sensors are transmitted via the sub-controller means to the service gateway, where they are compiled, and the service gateway is controlled by the remote control unit in a way that measurement values from different sensors are combined.

10 Claims, 3 Drawing Sheets

U.S. PATENT DOCUMENTS 6,161,005 A 12/2000 Pinzon
6,437,692 B1 * 8/2002 Petite et al. ..... 340/540
6,496,575 B1 * 12/2002 Vasell et al. ..... 379/102.05
6,861,952 B1 * 3/2005 Billmaier ..... 340/531
6,891,838 B1 * 5/2005 Petite et al. ..... 370/401
6,895,241 B1 * 5/2005 Hara ..... 455/420
6,914,533 B1 * 7/2005 Petite ..... 340/628

FOREIGN PATENT DOCUMENTS

WO 01/84793 A1 11/2001

* cited by examiner

Today

Prior art suggestion

Present invention

METHOD AND SYSTEM FOR CONTROL AND MAINTENANCE OF RESIDENTIAL SERVICE NETWORKS

This application is the US national phase of international application PCT/SE02/01143, filed in English on 13 Jun. 2002, which designated the US. PCT/SE02/01143 claims priority to SE Application No. 0102118-7 filed 13 Jun. 2001. The entire contents of these applications are incorporated herein by reference.

TECHNICAL FIELD OF THE INVENTION

This invention generally relates to a method and system for controlling residential services. More in particular, the invention relates to an improved functional infra-structure for hosting and maintaining residential networks.

BACKGROUND OF THE INVENTION

In homes and office buildings of today, many facilities and functions are controlled and maintained by electronics and automated management systems. Those control systems applies not only to traditionally used climate control, remote controlled curtains and air flow regulation systems, but nowadays also to security applications, such as locking devices and alarm systems, electric lighting and kitchen appliances to mention only a few of the many possibilities.

Several management systems have been proposed for handling and controlling residential functions, both in people's homes and in office buildings. One of the proposed service gateway systems is disclosed in the international patent application WO 99/65192, which is a multi-service gateway and communication platform for connectivity based systems. A residential platform and control system is described, intended to simultaneously control and regulate a large number of residential services. Due to the large number and variation of implemented residential services managed by the mentioned service gateway system, the complexity related to developing such a single gateway hosting a large number of services shall not be under-estimated. A service gateway system like the one in the above-mentioned international patent application must be unconditionally adapted to, and meet all standards involved in each application area. Sometimes various services and standards are difficult or even impossible to combine, like for instance how to keep the right balance between protection of high-security applications such as alarm and energy control, and simultaneously managing medium-security entertainment applications such as gaming and news services.

Another difficulty for the developer or manufacturer of residential management systems are safety requirements from several involved public authorities, including fire departments and insurance companies. Unless all the requirements from each involved public authority and institution are met, the developed management system will not be approved by the authorities and institutions for public use in large scale, even though it may be very promising.

However, consideration to all requirements that a residential management system is confronted with, inevitably makes the system expensive. Moreover, it might even be too complicated to build a general system which meets requirements on different markets. Thus, large volume production may not even be possible, which is an absolute prerequisite for reaching an attractive price on the market.

Hence, there is a need for a simplified technique leading towards less costly residential management systems for controlling and handling residential services, primarily provided in people's homes.

SUMMARY OF THE INVENTION

It is therefore an object of this invention to provide a simplified residential management system. The present invention overcomes the problems associated with prior art technology by means of a system for controlling at least one residential property in a plurality of connected residential networks, the system comprising:

- a remote control unit arranged to control residential properties, which remote control unit via the Internet is in connection with
- an access network, which is provided and supported by a telecommunications operator,
- each connected residential network is divided into an open branch containing content terminals, such as a personal computer and an interactive information terminal, characterised in that

- a service gateway is arranged in anyone of an open or secure branches of the residential network,
- the secure branch is provided with sub-controller means, each of which is in bi-directional connection with at least one sensor, the sub-controller means being adapted to activate various residential properties,
- measurement values from the sensors are transmitted via the sub-controller means to the service gateway, where they are compiled, and
- the service gateway is controlled by the remote control unit in a way that measurement values from different sensors are combined.

Moreover, the problems associated with prior art systems are alleviated by means of a method for controlling at least one residential property in a plurality of connected residential networks, the method characterised by the steps of:

- arranging a service gateway in anyone of the open or secure branches of the residential network,
- providing the secure branch of the residential network with sub-controller means, each of which is in bi-directional connection with at least one sensor,
- adapting the sub-controller means to activate various residential properties,
- transmitting measurement values from the sensors via the sub-controller means to the service gateway, where they are compiled, and
- controlling the service gateway by the remote control unit in a way that measurement values from different sensors are combined.

The present invention offers the optimum solution, even though it is a pragmatic solution, for overcoming the problem of meeting standard requirements and demands from various authorities, while maintaining reasonable development efforts and a competitive and attractive market price on the residence management system. Nevertheless, all requirements for a secure, robust and remotely managed residential control system are met. Due to the simplification of the traditional residential management system, it becomes affordable to the customer while simultaneously enhancing security and reliability in comparison with other residential systems. By means of the present invention, various residential functions can be controlled in dependence of one another, which makes it possible to enhance system functionality and reduce costs.

Since the present invention is general and adaptable to different service providers in various areas of activity, the solutions do not have to be tailored or even centred around the service gateway to the same extent as with prior art residential management systems. The invention is dynamic and can easily be adapted or extended to the surrounding system architecture environment and topology, which often varies more or less over time. Therefore, the present invention is beneficial to consumers as well as to vendors, developers and manufacturers of equipment for residential management systems.

BRIEF DESCRIPTION OF THE DRAWINGS

The features, objects, and further advantages of this invention will become apparent by reading this description in conjunction with the accompanying drawings, in which like reference numerals refer to like elements and in which.

DETAILED DESCRIPTION

The following description is of the best mode presently contemplated for practising the invention. The description is not to be taken in a limiting sense, but is made merely for the purpose of describing the general principles of the invention. The scope of the invention should be ascertained with reference to the issued claims.

It will be appreciated by those of ordinary skill in the art that this invention can be embodied in other specific forms without departing from its essential character. The embodiments described below should therefore be considered in all respects to be illustrative and not restrictive.

Figure 1:
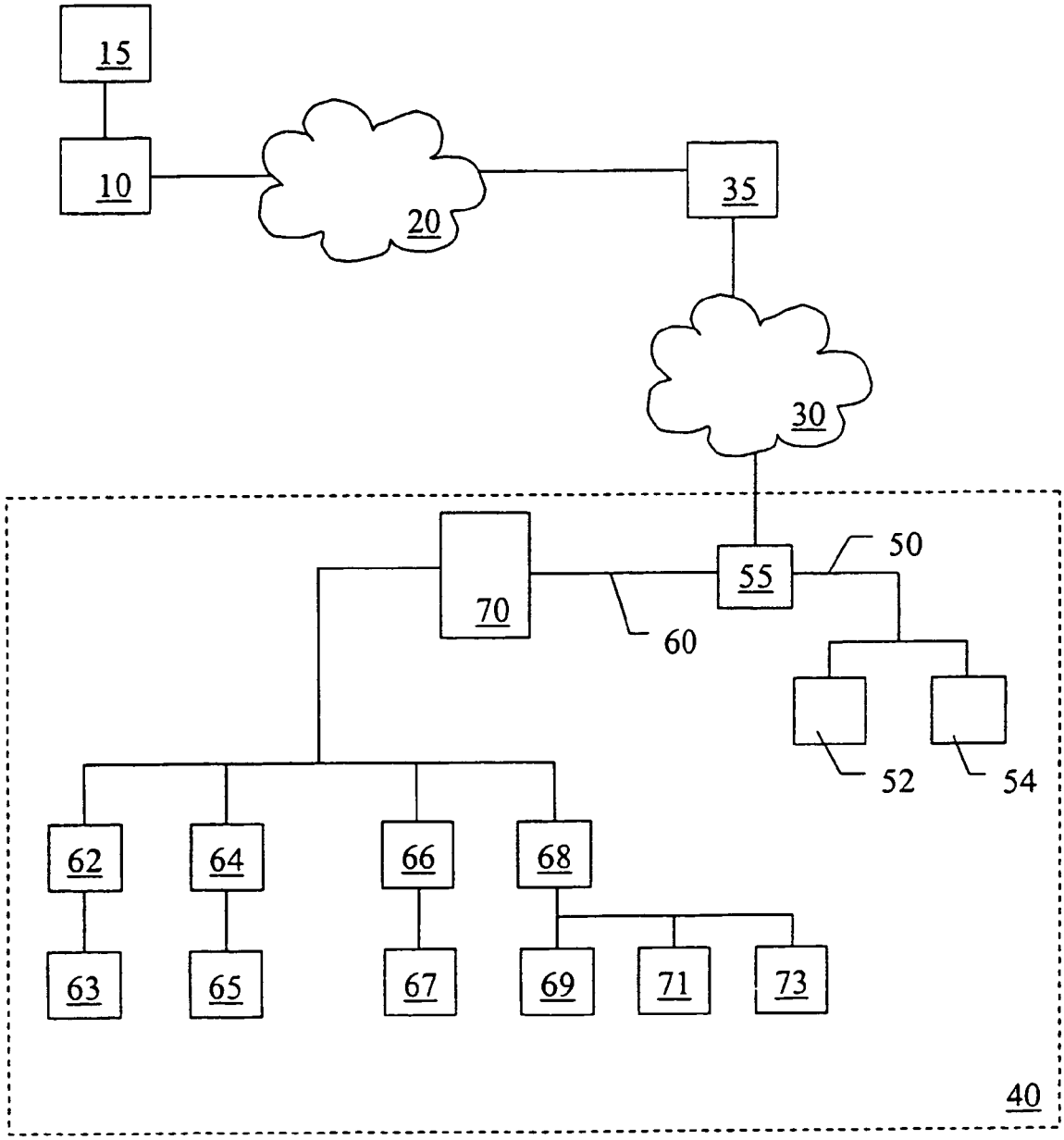
FIG. 1 schematically illustrates the residential management system according to the present invention.

FIG. 1 schematically illustrates the residential management system according to the present invention. The system comprises a remote control unit 10 from which the functionality of the system is monitored and from which the large number of connected residential networks can be controlled and overviewed, preferably on an associated display unit 15 with an interactive user interface, like for instance a touch screen, speech recognition unit or keyboard. The remote control unit 10 is connected to an access network 30 via the Internet or any other similar and global interconnecting network 20. The external network may also be connected via other access technologies and evolve freely with developments generally within the field of access technologies, and a conceivable development of access technology is wireless access in a few years of time. At present, in most cases the access network 30 is a PSTN (public switched telephone network) which is managed and maintained by any local telecommunications operator 35. It is beneficial for vendors of residential management systems to use such existing telephony networks since they already provide connections to virtually every household, at least in the industrialised regions of the world, but also in many of the so-called developing countries.

Still with reference to FIG. 1, the access network 30 reaches the client side of the illustration, i.e. the network residing within the user's household, which network will be called the residential network 40 throughout this document. This residential network 40 is divided into one open branch 50 and secure branch 60. A network distributor 55 allocates bandwidth to the open and secure branches 50, 60 respectively, in accordance with their current needs. The open branch 50 is used for applications such as one or more personal computers 52, with protection from harmful and sometimes even illegal intrusion from the outside, the protection by means of state of the art virus scanners and virus shields for various computer equipment. Another conceivable open application may be the ScreenFridge™, an information terminal 54 in the shape of a fully operative refrigerator equipped with an interactive display unit. In addition to that, the information terminal 54 is provided with various interactively controlled tools for planning and organising a family's activities, a touch screen for interaction and a software package controlling and supporting the functionality of the information terminal 54.

The other branch of the residential network 40, i.e. the secure branch 60 is provided with an extended service gateway 70. The residential network 40 behind the service gateway is the secure part of the network and the place for secure applications, such as door locks and window locks, alarm systems, climate control, timer arrangements for the lighting and kitchen appliances among others. There is a very large number of possible residential functions to be controlled by a management system according to the present invention, and only a few of them will be described in this document. The residential management system is mostly installed in the users' homes, but office buildings and shops are not at all excluded. A sub-controller means 62, 64, 66, 68 is positioned between the sensors 63, 65, 67, 69 and the service gateway 70, whereby the sensors 63, 65, 67, 69 are sensing the state or value of a certain quantity or condition in the user's home. This sub-controller means 62, 64, 66, 68 collects the current state information or a measurement value from the sensors 63, 65, 67, 69 and controls the corresponding residential system in response to received data.

One example of an application is a lock sensor 63, sensing whether a lock is closed or not. The associated sub-controller 62 is adapted to switch between locked and unlocked state depending on the desired state of operation. The desired state of operation is decided by the remote control unit 10, which is authorised to control the particular sub-controller 62 via the extended service gateway 70. Authentication and authorisation technologies within the residential management system according to the present invention will not be described here more in detail, since they go beyond the scope of this document.

Another example of an application controlled in a similar way is a movement detector 65 positioned in any of the rooms within a user's residence, which detector 65 senses whether movement occurs in a room where nobody is supposed to be found at a certain moment in time. The movement detector 65 is coupled to an alarm system 64 sensing whether the detector senses movement. The alarm system continuously reports the current state to the remote control unit 10 and the alarm system 64 activates an alarm signal in response to the movement detection. This response is also monitored and controlled by the remote control unit 10.

It is to be understood that the remote control unit 10 is not at all limited to one single unit, but may comprise a plurality of domains. Operative responsibilities of the domains may be delegated to closely co-operating partners who are specialised in their respective fields of services, such as residential security or energy services. Before delegating operative responsibilities, those must be approved first by the owners and all remotely controlled operations are monitored and recorded for possible future use.

A third example of a residential application is a temperature sensor 67, reporting the indoor temperature to a climate control unit 66, which acts in response to the measured and reported temperature. If the remote control unit 10 has supplementary information about desired climate, e.g. during a longer time of absence like vacation for the family living in the residence, the climate control unit 66 acts accordingly.

Yet another example of residential applications are timers 69, operational mode sensors 71 as well as temperature sensors 73 related to various kitchen appliances 68. These sensor values may be reported to the extended service gateway 70 and forwarded to the remote control unit 10 via the kitchen appliance 68 in question. From the remote control unit 10, kitchen appliances can be controlled with regards to their current state of operation and operative modes. Appliances do not necessarily have to be kitchen appliances, but also washing machines or any other residential means or appliances are conceivable.

However, the possibility of combining data reported from the sensors at the service gateway 70 leads to a wide range of new advantages. By means of using knowledge retrieved and gathered at the remote control unit 10 from a plurality of sub-controllers 62, 64, 66, 68 the automated management of the residence can be optimised. A piece of information derived from one of the comprised sensors can be used by the remote control unit 10 for controlling the sub-controller of another sensor. This is advantageous to the user of a residential management system, as it can be used for reducing risks, in particular for children, as well as reducing flexible costs related to the maintenance of a residence. An example is to combine features like control of the heating and lighting of a house with movement detectors of an alarm system intended to indicate burglary or sense family members or vehicles returning home. It is plausible that such a combination of sensors controlled by the remote control unit 10 substantially can reduce costs for the owner of a house, due to the possibility of decreasing heating and lighting in parts of a house where nobody is. Another beneficial combination of features controlled by the remote control unit 10 is that all lights and appliances can be turned off automatically as soon as the last person leaves a residence. The combination of locking the door when leaving the residence that is coupled to turning off lights and appliances is an arrangement controlled by the remote control unit 10.

According to a further embodiment, the remote control unit 10 is accessed via a mobile terminal, such as a mobile telephone. Hereby is achieved a possibility to unlock the outer door at remote distance, for instance to let craftsmen inside the house while nobody is at home, without the usual but hazardous way of hiding a key somewhere in the garden or leaving the key to the craftsmen in advance. Yet another embodiment is to turn off hot plates in the kitchen if nobody is present in the kitchen over a certain period of time, such as for example 10 minutes. This requires coupling of the movement sensor 65 of the kitchen area with timer 69 and temperature sensor 73 of the kitchen appliance in question, which is one of the advantages of the present invention.

Moreover, by means of the invention, only one motion sensor has to be installed in a room instead of several, probably identical or at least similar motion sensors. The single motion sensor can be used both for sensing values intended for controlling the climate system and the alarm system. Not the least for cost reasons, it is beneficial to the owner of a house equipped with an installed and operational residential management system to use each sensor for multiple purposes. According to prior art, one sensor has been required for each measurement purpose. Installation of prior art systems also tend to be rather tedious due to the large number of sensors and actuators for each measurement purpose. If connection between the remote control unit 10 and at least one sensor 63, 65, 67, 69 for some reason can not be established, the residential management system is adapted to continue controlling other residential functions which are not affected by the non-established connection.

Unlocking the front door of one's house or apartment at a distance may be associated with a feeling of insecurity to the owner. This is understandable, and so are other experienced and sometimes uncomfortable feelings of the users of newly introduced technology. However, in the longer run, practical benefits of customer services tend to outweigh the owner's initial uncomfortable feelings. Another advantage of the present invention is that the security aspect of the sub-controller control is improved relative prior art systems. When an established connection between one of the sub-controllers 62, 64, 66, 68 and the remote control unit 10 fails, the sub-controller immediately restores the default mode of a feature, for example locks a previously unlocked locking system. In addition to that, a failing connection between the remote control unit 10 and any of the sub-controllers 62, 64, 66, 68, for instance the lock sub-controller 62, also deactivates, the possibility of unlocking the front door of the house until proper and functional connection is re-established.

Figure 2:
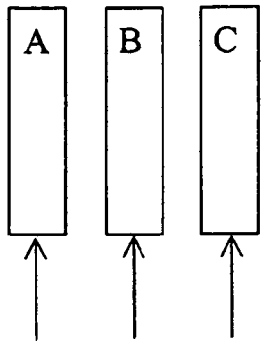
FIG. 2 is a chart comparing two different known residential management systems with the management system according to the invention.
Figure 2:
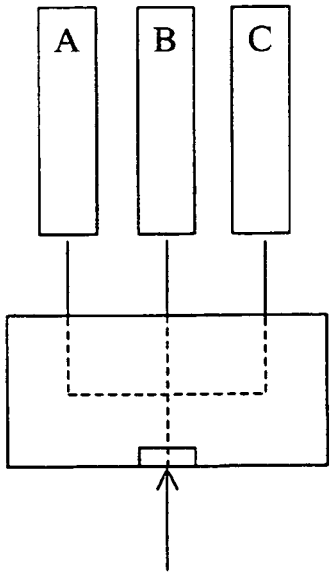
Figure 2:
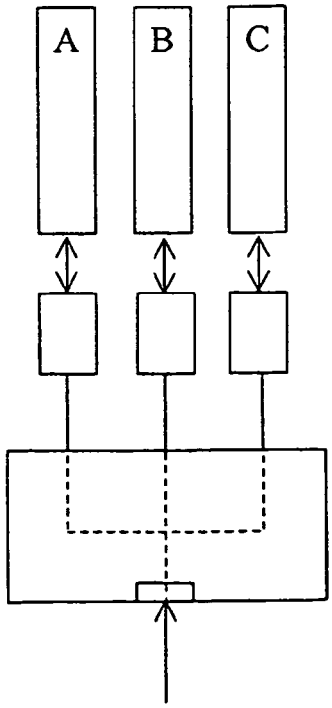

FIG. 2 is a chart comparing two different known residential management systems with the management system according to the present invention. On top is depicted the present situation in most homes of today. Different means in a home are controlled separately without any co-ordination. An example is radiators in a home that are controlled by mechanisms provided on each radiator. In between, a prior art system is depicted. Prior art has already been described extensively, and a general approach is to control a large number of items by means of one common residential management unit. This residential management unit is accessed by one single access point from which every feature is controlled. He present invention is depicted below whereby each feature is controlled from one single access point, but via intermediate sub-controllers. FIG. 2 is meant to be supportive in order to understand the general approaches of the present situation, prior art solutions and the present inventive idea. However, a plurality of different implementations of the general idea may be comprised within the scope of the invention.

Figure 3:
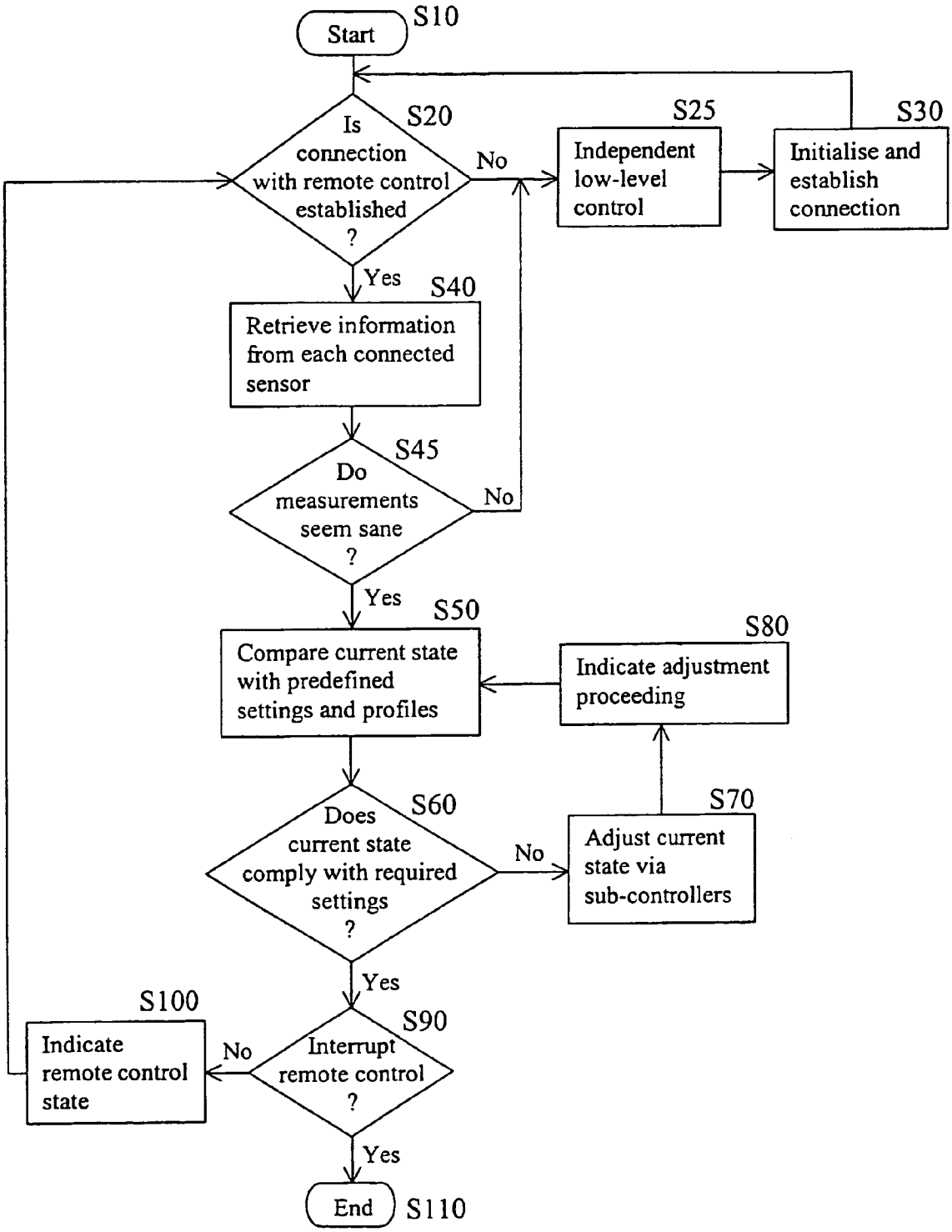
FIG. 3 is a flow chart depicting the functionality of the management system according to the present invention.

FIG. 3 is a flow chart depicting the functionality of the residential management system according to the present invention. The method steps start (S10) with an inquiry whether a connection is established (S20) between each sensor 63, 65, 67, 69 and the remote control unit 10. If connection is defective, the independent low-level control of the residential system is activated (S25) while a new connection is initialised and established (S30). In case the connection is correctly established, information is retrieved (S40) from each of the connected sensors. A so-called "sanity check" (S45) is carried out, which is a check of whether the retrieved measurement information is within a probable range. If not, the sequence continues with independent low-level control (S25). If the sanity check yields a probable range, next step in the functional sequence is to compare (S50) the current state of the residence with predefined settings and if appropriate, with predefined profiles. If the current state does not comply (S60) with the desired settings, the current state is adjusted (S70) via any of the provided sub-controllers. For convenience reasons and for information to the user of the residential management system, it is plausible to indicate (S80) that adjustments of the current state are proceeding. After that adjustment step, the sequence returns back to the comparison step (S50) of the operational sequence. However, in case the current state fully complies (S60) with desired settings, an inquiry is made whether to interrupt (S90) the remote control. If not, the indication of remotely controlled residential services is displayed (S 100) and the sequence continues back for a new loop from the previous step of checking (S20) whether a fully operational connection is established. If the user or owner instead of continuing the sequence chooses to interrupt the remote controlled residential services (S90), the operational sequence ends (S110).

According to another embodiment of the present invention, the remote control unit 10 is hosted by, or integrated with, the extended service gateway 70. This is solution is applicable in particular when there is a desire to combine residential control functions even if there is little or no infrastructure outside of the home. A stand alone unit with many of the above described advantages is created by means of this embodiment. That is often the case in remotely situated homes or sparsely populated rural areas.

In accordance with the present invention, software is developed in parallel with the residential management system is utilised for controlling various means. The software resides in a memory located in the hardware of the remote control and the extended service gateway. The software is designed for instructing the hardware of the residential management system to carry out the sequential method steps described with reference to FIG. 3.

The invention claimed is:

1. A system for controlling at least one residential property in a plurality of connected residential networks (40), the system comprising:

a remote control unit (10) arranged to control residential properties, which remote control unit (10) via an interconnecting network (20) is in connection with an access network (30), which is provided and managed by a telecommunications operator (35), each connected residential network (40) is divided into an open branch (50) containing content terminals such as a personal computer (52) and an inter-active information terminal (54), and a secure branch (60), characterised in that a service gateway (70) is arranged in any one of the open (50) or secure branches (60) of the residential network (40), the secure branch (60) is provided with sub-controller means (62, 64, 66, 68), each of which is in bi-directional connection with at least one sensor (63, 65, 67, 69), the sub-controller means (62, 64, 66, 68) being adapted to activate various residential properties, measurement values from the sensors (63, 65, 67, 69) are transmitted via the sub-controller means (62, 64, 66, 68) to the service gateway (70), where they are compiled, and the service gateway (70) is controlled by the remote control unit (10) in a way that measurement values from different sensors (63, 65, 67, 69) are combined.

2. A system according to claim 1, characterised in that the remote control unit (10) is hosted by the service gateway (70), inde-pendently of the open branch (50) and the network environment (20, 30).

3. A system according to claim 1, characterised in that the remote control unit (10) is a mobile terminal, such a mobile telephone, personal digital assistant (PDA) or any other mobile communication means.

4. A system according to claim 1, characterised in that the various residential properties are measured by means of at least one of the following types of sensors (63, 65, 67, 69): temperature, movement, light, radiation, humidity, contact or touch sensors, vibration, volume, etc.

5. A system according to claim 1, characterised in that the access network (30) is a public switched telephone network (PSTN).

6. A method for controlling at least one residential property in a plurality of con-nected residential networks (40), the method characterised by the steps of:

arranging a service gateway (70) in anyone of the open (50) or secure (60) branches of the residential network (40), providing the secure branch (60) of the residential network (40) with sub-controller means (62, 64, 66, 68), each of which is in bi-directional connection with at least one sensor (63, 65, 67, 69), adapting the sub-controller means (62, 64, 66, 68) to activate various residential properties, transmitting measurement values from the sensors (63, 65, 67, 69) via the sub-controller means (62, 64, 66, 68) to the service gateway (70), where they are compiled, and controlling the service gateway (70) by the remote control unit (10) in a way that measurement values from different sensors (63, 65, 67, 69) are combined.

7. A method according to claim 6, characterised in that determining by the remote control unit (10) which residential functions can still be controlled when connection can not be established with at least one sensor (63, 65, 67, 69).

8. A method according to claim 6, characterised by controlling the service gateway (70) by means of a mobile terminal, such a mobile telephone, personal digital assistant (PDA) or any other mobile communication means.

9. A method according to claim 6, characterised by accessing connecting residential networks (40) via the public switched telephone network (PSTN).

10. A computer program product for controlling at least one residential property in a plurality of connected residential networks (40), the computer program product characterised by means for controlling the execution of the method steps of claim 6.

* * * * *